US008870360B2

(12) United States Patent
Hirata et al.

(10) Patent No.: US 8,870,360 B2
(45) Date of Patent: Oct. 28, 2014

(54) METHOD OF DEALING WITH CURL, DROPLET EJECTING APPARATUS, AND STORAGE MEDIUM FOR COMPUTER-READABLY STORING PROGRAM FOR DEALING WITH CURL

(75) Inventors: Kenichi Hirata, Nagoya (JP); Hisashi Igi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 315 days.

(21) Appl. No.: 13/249,976

(22) Filed: Sep. 30, 2011

(65) Prior Publication Data

US 2012/0162300 A1 Jun. 28, 2012

(30) Foreign Application Priority Data

Dec. 28, 2010 (JP) ..... 2010-293987

(51) Int. Cl.

| | |
|---|---|
| ***B41J 2/01*** | (2006.01) |
| ***B41J 11/00*** | (2006.01) |
| ***B41J 2/155*** | (2006.01) |
| ***B41J 2/21*** | (2006.01) |

(52) U.S. Cl.

CPC ..... *B41J 2/155* (2013.01); *B41J 11/005* (2013.01); *B41J 2/2114* (2013.01)

USPC ..... 347/102

(58) Field of Classification Search

CPC ..... B41J 11/005; B41J 11/002

USPC ..... 347/102

See application file for complete search history.

(56) References Cited

U.S. PATENT DOCUMENTS

| | | | | |
|---|---|---|---|---|
| 2007/0064032 | A1 | 3/2007 | Kawabata | |
| 2009/0147039 | A1 | 6/2009 | Koase | |
| 2009/0244634 | A1 * | 10/2009 | Hasegawa et al. | 358/3.23 |
| 2010/0309238 | A1 | 12/2010 | Taniguchi | |

FOREIGN PATENT DOCUMENTS

| | | | |
|---|---|---|---|
| CN | 101905577 | A | 12/2010 |
| EP | 2036736 | A2 | 3/2009 |

(Continued)

OTHER PUBLICATIONS

Japan Patent Office, Notification of Reason for Refusal for Japanese Patent Application No. 2010-293987 (counterpart Japanese patent application), mailed Feb. 26, 2013.

European Patent Office, extended European Search Report for European Patent Application No. 11183320.8 (counterpart to above-captioned patent application), dated Apr. 17, 2012.

(Continued)

*Primary Examiner* — Julian Huffman

(74) *Attorney, Agent, or Firm* — Baker Botts L.L.P.

(57) ABSTRACT

A method of reducing a curl of a recording medium caused by ejection of a liquid by a droplet ejecting apparatus to the medium including steps of calculating an ejected-liquid amount ejected onto an evaluation region defined on the medium and an ejected-liquid associated quantity which is an ejected-liquid-droplet number ejected to the evaluation region or an ejected-area associated quantity which is an area of unit regions to which the liquid is ejected; and a ratio of the area of the unit regions to an area of the evaluation region, and estimating a curl degree of the medium caused by ejection of the liquid thereto or a correction degree necessary for restraining the curl, based on a position of the evaluation region; and the calculated ejected-liquid amount and ejected-liquid associated quantity.

14 Claims, 10 Drawing Sheets

(56) References Cited

FOREIGN PATENT DOCUMENTS

| | | | |
|---|---|---|---|
| JP | 2009-143010 | A | 7/2009 |
| JP | 2009-143011 | A | 7/2009 |
| JP | 2009-143012 | A | 7/2009 |
| JP | 2009-143013 | A | 7/2009 |
| JP | 2010-253726 | A | 11/2010 |

OTHER PUBLICATIONS

State Intellectual Property Office of the People'S Republic of China, Notification of First Office Action for Chinese Patent Application No. 201110306729.8 (counterpart to above-captioned patent application), mailed Dec. 3, 2013.

State Intellectual Property Office of the People's Republic of China, Notification of Second Office Action issued for Chinese Patent Application No. 201110306729.8, mailed Aug. 6, 2014.

* cited by examiner

FIG.3A Black

| | a | b | c | d | e | f |
|---|---|---|---|---|---|---|
| 1 | | | M | M | M | |
| 2 | | | M | | | |
| 3 | | L | M | | | |
| 4 | | | | | | |
| 5 | | | | | | |
| 6 | | | | | | |

FIG.3B Cyan

| | a | b | c | d | e | f |
|---|---|---|---|---|---|---|
| 1 | | | | | | |
| 2 | | | | | | |
| 3 | | | | | | |
| 4 | | M | | | | |
| 5 | | L | M | | | |
| 6 | | | | | | |

FIG.3C Magenta

| | a | b | c | d | e | f |
|---|---|---|---|---|---|---|
| 1 | | | | | | |
| 2 | | | | | | |
| 3 | | | | | | |
| 4 | | | | | S | |
| 5 | | | | L | M | |
| 6 | | M | S | M | | |

FIG.3D Yellow

| | a | b | c | d | e | f |
|---|---|---|---|---|---|---|
| 1 | | | | | | |
| 2 | | | | S | S | |
| 3 | | | | S | S | |
| 4 | | S | | S | S | |
| 5 | | L | M | S | M | |
| 6 | | | | | | |

99
CONVEYANCE DIRECTION

FIG.4

| | a | b | c | d | e | f |
|---|---|---|---|---|---|---|
| 1 | | | S | S | S | |
| 2 | | | S | S | S | |
| 3 | | S | S | S | S | |
| 4 | | S | | S | S | |
| 5 | | S | S | S | S | |
| 6 | | S | S | S | | |

99
CONVEYANCE DIRECTION

METHOD OF DEALING WITH CURL, DROPLET EJECTING APPARATUS, AND STORAGE MEDIUM FOR COMPUTER-READABLY STORING PROGRAM FOR DEALING WITH CURL

CROSS REFERENCE TO RELATED APPLICATION

The present application claims priority from Japanese Patent Application No. 2010293987, which was filed on Dec. 28, 2010, the disclosure of which is herein incorporated by reference in its entirety.

BACKGROUND OF THE INVENTION

1. Field of the Invention

The present invention relates to a droplet ejecting apparatus configured to eject a liquid such as ink for forming an image on a recording medium and to a technique of dealing with a curl of the recording medium, more particularly, to a technique of estimating or predicting a degree of the curl of the recording medium and/or a correction degree of the curl.

2. Discussion of Related Art

There is known an ink-jet printer, as one example of a droplet ejecting apparatus, configured to form an image on a recording medium by ejecting ink to the recording medium such as paper, cloth, or a film. The ink-jet printer often uses water-soluble ink. The water-soluble ink contains a large amount of water as a solvent. Due to the water component contained in the ink, there may be caused a curl of the recording medium to which the ink has been attached by image formation. The degree and the state of the curl vary depending upon conditions of the attached ink. In general, when a difference in the amount of the water component becomes large between a front surface and a back surface of the recording medium due to the attachment of the ink to the recording medium, the curl is likely to occur. Where the recording medium suffers from the curl, the recording medium is not stacked in good order when discharged, causing a trouble that the recording medium is bent or placed out of position. Accordingly; it is preferable to accurately estimate or predict the curl of the recording medium and to appropriately restrain the curl. In view of this, there is proposed a curl predicting method in which a liquid amount ejected by a droplet ejecting apparatus to each of regions defined on the recording medium is calculated and the curl state of the recording medium is predicted on the basis of a position of each region and the liquid amount ejected to the corresponding region.

SUMMARY OF THE INVENTION

There is known the following. Even where the recording medium is coated with the same amount of ink, a mechanism by which the curl occurs differs between a case in which the entirety of the recording medium is coated with the ink and a case in which the recording medium is locally coated with the ink. In view of this, the curl state of the recording medium is predicted on the basis of a position of a certain region set in the recording medium and a liquid amount ejected to the region. In contrast, the inventors of the present invention have found that, where a certain region is set in the recording medium, a degree of the curl of the recording medium is influenced by a number of droplets of the liquid ejected to the region (i.e., ejected-liquid-droplet number), in addition to the position of the region on the recording medium and the liquid amount ejected to the region. Further, it has been found that the number of the liquid droplets ejected to the region considerably largely influences the curl degree of the recording medium. This seems to be attributable to the fact that a number of liquid droplets and a liquid amount per unit area of the recording medium does not necessarily correspond to each other in image formation by a droplet ejecting apparatus configured to achieve tone representation by utilizing different sizes of droplets. Therefore, the proposed technique may not necessarily ensure accurate prediction of the curl degree of the recording medium. In an instance where the predicted curl degree of the recording medium is inaccurate, the curl may not be sufficiently corrected or it may take more time and energy than necessary to correct the curl when the curl is corrected on the basis of the inaccurately predicted curl degree.

It is therefore an object of the invention to appropriately deal with a curl which occurs in a recording medium after image formation thereon by a droplet ejecting apparatus.

The above-indicated object of the invention may be achieved according to one aspect of the invention, which provides a method of dealing with a curl of a recording medium caused by ejection of a liquid by a droplet ejecting apparatus to the recording medium, comprising the steps of:

calculating (I) an ejected-liquid amount which is an amount of the liquid ejected by the droplet ejecting apparatus to an evaluation region defined on the recording medium and (II) an ejected-liquid associated quantity which is one of (a) an ejected-liquid-droplet number which is a number of droplets of the liquid ejected to the evaluation region and (b) an ejected-area associated quantity which is one of: an area of unit regions in the evaluation region to which the liquid is ejected; and a ratio of the area of the unit regions to an area of the evaluation region, and estimating at least one of: a curl degree which is a degree of the curl of the recording medium caused by ejection of the liquid to the recording medium; and a correction degree which is a degree of correction necessary for restraining the curl, on the basis of: a position of the evaluation region; and the ejected-liquid amount and the ejected-liquid associated quantity calculated in the calculating step.

Here, the "ejected-liquid associated quantity" and the "ejected-area associated quantity" may be also referred to as "ejected-liquid associated amount" and "ejected-area associated amount", respectively. Further, the "ejected-liquid associated quantity" and the "ejected-area associated quantity" may be also referred to as "ejected-liquid related amount" and "ejected-area related amount", respectively.

The above-indicated object of the invention may be achieved according to another aspect of the invention, which provides a droplet ejecting apparatus, comprising:

at least one liquid ejecting head for ejecting a liquid to a recording medium;

a liquid-ejection-data storage portion for storing liquid-ejection data on the basis of which the liquid is ejected so as to correspond to an image to be formed on the recording medium;

a liquid-ejecting-head control portion for controlling the at least one liquid ejecting head on the basis of the liquid-ejection data;

a calculating portion for calculating (I) an ejected-liquid amount which is an amount of the liquid ejected by the droplet ejecting apparatus to an evaluation region defined on the recording medium and (II) an ejected-Liquid associated quantity which is one of (a) an ejected-liquid-droplet number which is a number of droplets of the liquid ejected to the evaluation region and (b) an ejected-area associated quantity which is one of: an area of unit regions in the evaluation region to which the liquid is ejected; and a ratio of the area of the unit regions to an area of the evaluation region, and an estimating portion for estimating at least one of: a curl degree which is a degree of the curl of the recording medium caused by ejection of the liquid to the recording medium and a correction degree which is a degree of correction necessary for restraining the curl, on the basis of: a position of the evaluation region; and the ejected-liquid amount and the ejected-liquid associated quantity calculated in the calculating step.

The above-indicated object of the invention may be achieved according to still another aspect of the invention, which provides a computer-readable storage medium in which is computer-readably stored a program to be executed by a computer of a droplet ejecting apparatus, in order to deal with a curl of a recording medium caused by ejection of a liquid by the droplet ejecting apparatus to the recording medium, the program including the steps of:

calculating (I) an ejected-liquid amount which is an amount of the liquid ejected by the droplet ejecting apparatus to an evaluation region defined on the recording medium and (II) an ejected-liquid associated quantity which is one of (a) an ejected-liquid-droplet number which is a number of droplets of the liquid ejected to the evaluation region and (b) an ejected-area associated quantity which is one of: an area of unit regions in the evaluation region to which the liquid is ejected; and a ratio of the area of the unit regions to an area of the evaluation region; and estimating at least one of: a curl degree which is a degree of the curl of the recording medium caused by ejection of the liquid to the recording medium; and a correction degree which is a degree of correction necessary for restraining the curl, on the basis of: a position of the evaluation region; and the ejected-liquid amount and the ejected-liquid associated quantity calculated in the calculating step.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which:

FIG. 3 is a view showing ink-ejection data of a certain region, more specifically, FIG. 3A is ink-ejection data of black ink, FIG. 3B is ink-ejection data of cyan ink, FIG. 30 is ink-ejection data of magenta ink, and FIG. 3D is ink-ejection data of yellow ink;

FIG. 4 is a view showing treatment-liquid-ejection data of the certain region corresponding to the ink-ejection data of FIG. 3;

DETAILED DESCRIPTION OF THE EMBODIMENTS

Figure 1:
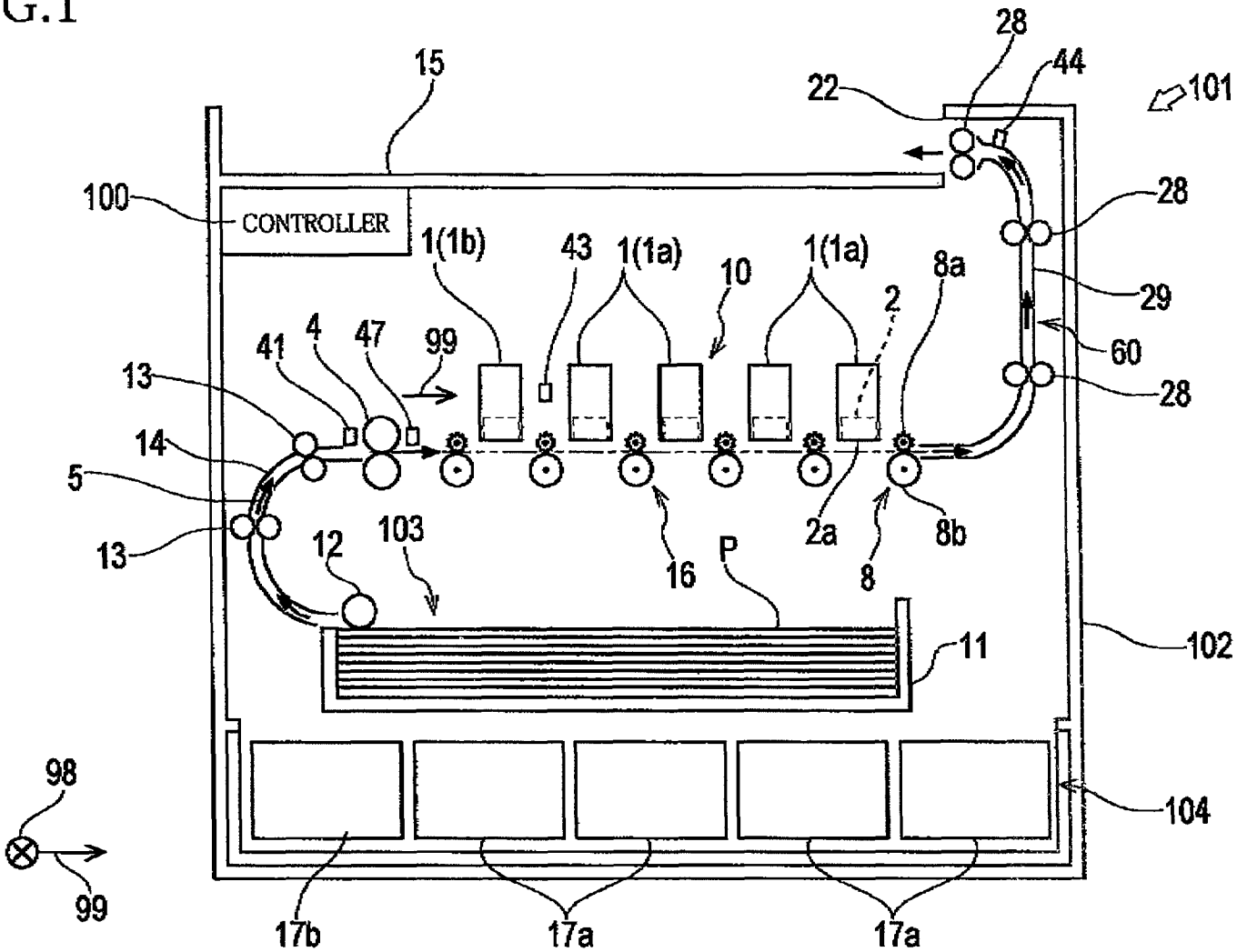
FIG. 1 is a schematic side view showing an overall structure of an ink-jet printer according to one embodiment of the invention.

There will be hereinafter described embodiments of the invention with reference to the drawings. The following description will be made with respect to an ink-jet printer as one example of a droplet ejecting apparatus to which the principle of the invention is applied. In the following description, the same reference numerals are used to identify the same or corresponding elements throughout the drawings, and the explanation is not repeated.

As shown in FIG. 1, the ink-jet printer 101 according to the present embodiment has a housing 102 having a generally rectangular parallepiped shape. In the housing 102, there are provided the following functional units so as to be arranged in the order of description in a direction from the top to the bottom of the housing 102: a head unit 10 constituted by five heads 1; a conveyance unit 16 configured to convey a sheet P, as a recording medium, in a conveyance direction 99 (i.e., a direction from the left to the right in FIG. 1) below the heads 1; a sheet supply unit 103 configured to supply the sheet P; and a tank unit 104 configured to store ink, etc. Further, a controller 100 configured to control the functional units is disposed at a position in the housing 102 at which the controller 100 does not interfere with the functional units. On the upper surface of the housing 102, there is provided a discharge portion 15 onto which the sheet P that has been subjected to printing is discharged.

Four of the five heads 1 of the head unit 1 are recording heads 1*a* configured to eject ink. In the present embodiment, there are provided four recording heads 1*a* for ejecting a black ink, a cyan ink, a magenta ink, and a yellow ink, respectively. The head 1 other than the four heads 1*a* is a treatment-liquid ejecting head 1*b* configured to eject a treatment liquid. Here, there is used, for pigment ink, a treatment liquid which coagulates a pigment coloring matter, and there is used, for dye ink, a treatment liquid which precipitates a dye coloring matter. As the main material of the treatment liquid, there is suitably used, depending upon the property of ink, a liquid containing a cationic compound, especially, a cationic high polymer or a cationic surface active agent, or a liquid containing a polyvalent metallic salt such as a calcium salt or a magnesium salt. When ink is attached to a region of the sheet P on which the treatment liquid has been coated, the polyvalent metallic salt or the like in the treatment liquid acts on a component of the ink, namely, a dye or a pigment as a colorant, so as to cause coagulation or precipitation of an insoluble or sparingly soluble metal complex or the like. As a result, the degree of permeation of the attached ink into the sheet P is lowered, so that the ink is likely to fix to or remain on the region close to the surface of the sheet P.

The treatment-liquid ejecting head 1*b* is disposed on the most upstream side in the conveyance direction 99 among the five heads 1. The four recording heads 1*a* are disposed on the downstream side of the treatment-liquid ejecting head 1*b* in the conveyance direction 99 in accordance with a descending order of ink lightness, namely, in the order of black, cyan, magenta, and yellow, from the upstream side toward the downstream side.

The five heads 1 have substantially the same structure. Each of the heads 1 has a generally rectangular parallepiped shape that is long in a recording-width direction 98. Accordingly; the present ink-jet printer 101 is of a line-head type. Here, the "recording-width direction 98" is a direction that is orthogonal to the conveyance direction 99 and that is horizontal. Each head 1 has a head body 2 with an ejection surface 2*a* in which a plurality of ejection openings (not shown) are open. The ejection surface 2*a* is configured to be opposed, in the vertical direction, to the sheet P that is conveyed by the conveyance unit 16 in the conveyance direction 99, such that a suitable spacing is interposed therebetween. Each head body 2 has a plurality of actuators (not shown) controlled by a head control portion 51 explained later. The actuators are configured to give ejection energy to the treatment liquid or the ink, so as to permit the treatment liquid or the ink to be selectively ejected from the corresponding ejection openings. In the present embodiment, the resolution in the recording-width direction 98 (a main scanning direction) and the resolution in the conveyance direction 99 (a sub scanning direction) are both 600 dpi. On the surface of the sheet P, there are virtually defined a plurality of unit regions (pixel regions) in a grid pattern or matrix, each of which has a square shape having a dimension of 1/600 inch in each of the recording-width direction 98 and the conveyance direction 99.

The tank unit 104 includes four ink tanks 17*a* and one treatment-liquid tank 17*b* which are detachably installed on the housing 102. The ink tanks 17*a* respectively store the black ink, the cyan ink, the magenta ink, and the yellow ink. Each ink is supplied from the ink tank 17*a* to a corresponding recording head 1*a* via a corresponding tube (not shown). Similarly, the treatment-liquid tank 17*b* stores the treatment liquid, and the treatment liquid is supplied from the treatment-liquid tank 17*b* to the treatment-liquid ejecting head 1*b* via a tube.

The sheet supply unit 103 includes a sheet tray 11 detachably mounted on the housing 102 and a sheet supply roller 12. The sheet tray 11 is a box-like shape which is open upward, and a stack of the sheets P is accommodated therein. The sheet supply roller 12 is in contact with the uppermost one of the sheets P accommodated in the sheet tray 11. When the sheet supply roller 12 is rotatingly driven by a sheet supply motor 31 (FIG. 2) that is operated under the control of the controller 100, the uppermost sheet P in the sheet tray 11 is supplied to a conveyance path 5 explained below.

In the housing 102, the conveyance path 5 for the sheet P is formed so as to extend from the sheet tray 11 to the discharge portion 15, as shown in black arrows in FIG. 1. The conveyance path 5 is defined by a plurality of feed-in guides 14, the conveyance unit 16, and a plurality of feed-out guides 29 so as to have a generally "S" shape shown in FIG. 1. The sheet P supplied from the sheet tray 11 by the sheet supply roller 12 is fed to the conveyance unit 16 by a plurality of feed roller pairs 13 via the feed-in guides 14. On the upstream side of the conveyance unit 16 in the conveyance path 5, a registration roller pair 4 is disposed. After the sheet P has been placed in an appropriate posture by the registration roller pair 4, the sheet P gets into the conveyance unit 16. The conveyance unit 16 is configured to send the sheet P to a position at which an image can be formed thereon and to convey the sheet P in the conveyance direction 99 at a suitable conveyance speed for image formation. When the sheet P passes below each of the heads 1, the treatment liquid and the respective inks are ejected to the sheet P, so that a desired color image is formed on the recording surface (the upper surface) of the sheet P. The image-recorded sheet P is sent from the conveyance unit 16 toward the downstream portion of the conveyance path 5, and is subsequently conveyed upward by a plurality of feed-out roller pairs 28 through a feed-out path 60 defined by the feed-out guides 29. Finally, the sheet P is discharged to the discharge portion 15 through a discharge opening 22 formed on the upper portion of the housing 102.

As shown in FIG. 1, the conveyance unit 16 includes a plurality of conveyance roller pairs 8, i.e., six conveyance roller pairs 8 in the present embodiment, which are disposed along the conveyance direction of the sheet P. Outermost two of the six conveyance roller pairs 8 are disposed respectively on the downstream side and the upstream side of the array of the five heads 1 in the conveyance direction 99, and the remaining four conveyance roller pairs 8 are disposed such that each conveyance roller pair 8 is located between adjacent two heads 1. Each conveyance roller pair 8 is constituted by a pair of upper and lower rollers, namely, constituted by a conveyance roller 8*b* and a toothed roller (spur roller) 8*a*. The conveyance roller 8*b* is disposed such that its circumferential surface comes into contact with the lower surface of the sheet P. The toothed roller 8*a* is disposed so as to be opposed to the circumferential surface of the corresponding conveyance roller 8*b* with the sheet P sandwiched therebetween. The toothed roller 8*a* includes a shaft extending in the recording-width direction 98 and a plurality of toothed discs (spurs) provided on the shaft so as to be spaced apart from each other. Each toothed disc is formed of a thin disc plate whose circumferential surface is formed with a plurality of teeth, tip ends of which come into contact with the sheet P. The toothed roller 8*a* is biased toward the corresponding conveyance roller 8*b* by a biasing means not shown, and the circumferential surface of the toothed roller 8*a* is in pressing contact with the circumferential surface of the conveyance roller 8*b*. When the conveyance rollers 8*b* in the conveyance unit 16 are rotatingly driven by a conveyance motor 33 (FIG. 2) in a synchronous manner, the sheet P is conveyed toward the downstream side in the conveyance direction 99, such that the sheet P is sandwiched between the toothed roller 8*a* and the conveyance roller 8*b* of each conveyance roller pair 8.

Figure 2:
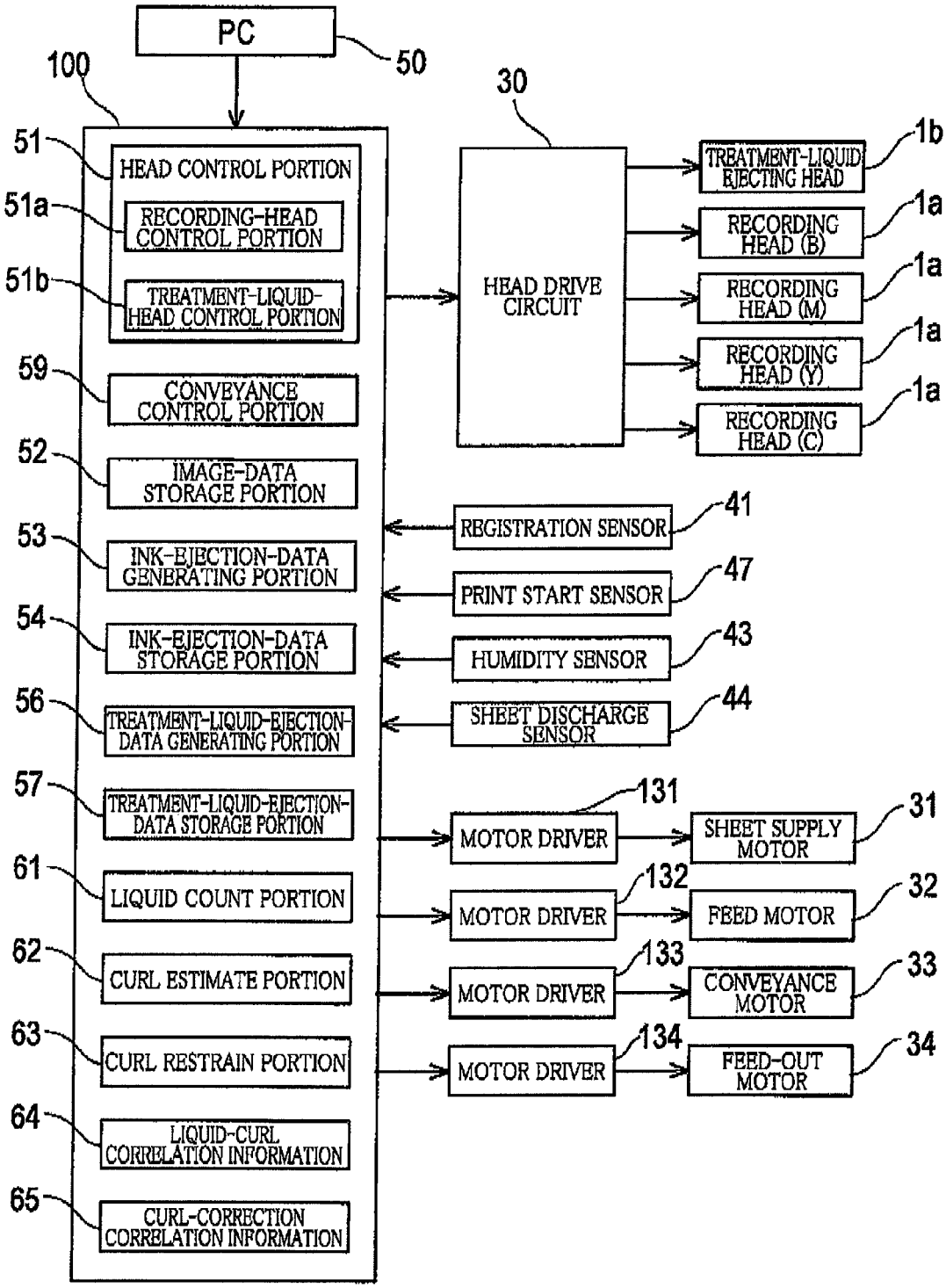
FIG. 2 is a functional block diagram of a controller.

Referring next to FIG. 2, the controller 100 will be explained. The controller 100 includes various functional portions such as the head control portion 51, a conveyance control portion 59, an image-data storage portion 52, an ink-ejection-data generating portion 53, an ink-ejection-data storage portion 54, a treatment-liquid-ejection-data generating portion 56, and a treatment-liquid-ejection-data storage portion 57. The controller 100 further includes various functional portions such as a liquid count portion 61, a curl estimate portion 62, and a curl restrain portion 63, and data such as liquid-curl correlation information 64 and curl-correction correlation information 65. The controller 100 includes a Central Processing Unit (CPU), nonvolatile memory which stores control programs to be executed by the CPU and which rewritably stores data to be utilized in the control programs, and a Random Access Memory (RAM) which temporarily stores data when the programs are executed. The control programs of the present invention are stored in a storage medium such as a flexible disk, a CD-ROM, or a memory card and is installed on the nonvolatile memory from the storage medium. The functional portions of the controller 100 shown in FIG. 2 are realized by execution of the control programs by the CPU.

To the controller 100, there are connected: a registration sensor 41 provided on the upstream side of the registration roller pair 4 in the conveyance path 5; a print start sensor 47 provided between the registration roller pair 4 and the treatment-liquid ejecting head 1*b*; a humidity sensor 43 provided between the treatment-liquid ejecting head 1*b* and the recording head 1*a*; and a sheet discharge sensor 47 provided at an end portion of the conveyance path 5. Each of the print start sensor 47 and the sheet discharge sensor 44 is configured to detect passing of the leading end and the trailing end of the sheet P through a detect position. The detection signal of the print start sensor 47 is utilized by the head control portion 51 to determine ejection timing of the treatment liquid or the ink from each head 1. The detection signal of the humidity sensor 43 is utilized for detecting clogging of nozzles of the heads 1. The detection signal of the sheet discharge sensor 44 is utilized for determining timing of stopping driving of the feed-out roller pairs 28. The registration sensor 41 is configured to detect passing of the leading end of the sheet P through a detect position. The detection signal of the registration sensor 41 is utilized for determining timing of decreasing a spacing between the rollers of the registration roller pair 4 for sheet conveyance and timing of placing the sheet P in an appropriate posture. The registration sensor 41 may be configured to also have the function of the print start sensor 47.

The conveyance control portion 59 of the controller 100 is configured to control the sheet supply unit 103, each feed roller pair 13, each conveyance roller pair 8, each feed-out roller pair 28, the registration roller pair 4, and the conveyance unit 16, for permitting the sheet P to be conveyed along the conveyance path 5. More specifically, the conveyance control portion 59 is configured to control a motor driver 131 of the sheet supply motor 31 for driving the sheet supply roller 12 of the sheet supply unit 103, a motor driver 132 of a feed motor 32 for driving each feed roller pair 13 and the registration roller pair 4, a motor driver 134 of a feed-out motor 34 for driving each feed-out roller pair 28, and a motor driver 133 of the conveyance motor 33 for driving each conveyance roller pair 8 of the conveyance unit 16.

The head control portion 51 includes a recording-head control portion 51*a* configured to control the actuators of each recording head 1*a* and a treatment-liquid-head control portion 51*b* configured to control the actuators of the treatment-liquid ejecting head 1*b*. The recording-head control portion 51*a* is configured to control an ink ejection operation of each recording head 1*a* via a head drive circuit 30 such that the ink is ejected toward the sheet P that is being conveyed, on the basis of ink ejection data stored in the ink-ejection-data storage portion 54 explained below. The treatment-liquid-head control portion 51*b* is configured to control a treatment-liquid ejection operation of the treatment-liquid ejecting head 1*b* via the head drive circuit 30 such that attaching positions of the ink and the treatment liquid coincide with each other on the sheet P, on the basis of treatment-liquid-ejection data stored in the treatment-liquid-ejection-data storage portion 57 explained below. In the present embodiment, the amount of the ink droplet or the treatment liquid droplet ejected from each head 1 can be changed in four steps, namely, zero, a small droplet, a medium droplet, and a large droplet.

The image-data storage portion 52 is configured to store image data relating to an image to be recorded on the sheet P. The image data is transferred to the controller 100 from a personal computer (PC) 50 connected to the ink-jet printer 101, a printer driver or the like. The ink-ejection-data generating portion 53 is configured to generate the ink ejection data on the basis of the image data stored in the image-data storage portion 52. The ink-ejection-data storage portion 54 is configured to store the generated ink ejection data. The ink ejection data indicates a size of a dot (dot size) to be formed on each of the unit regions (pixel regions) virtually defined on the sheet P. The dot size indicated by the ink ejection data indicates an amount of the ink to be ejected by each recording head 1*a* to each unit region on the sheet P, i.e., an ink amount corresponding to zero, the small droplet, the medium droplet, or the large droplet. In the following description, the dot size of one unit region indicated by the ink ejection data, namely, the amount of the ink to be ejected to a unit region on the sheet P corresponding to the one unit region, is referred to as "a droplet amount of the ink" or "an ink droplet amount" where appropriate.

FIG. 3 shows ink ejection data for a certain region, more specifically, FIGS. 3A-3D show ink ejection data for the black ink, the cyan ink, the magenta ink, and the yellow ink, respectively. For instance, the ink-ejection-data storage portion 54 stores four sorts of ink ejection data corresponding to the respective four recording heads 1*a*, as shown in FIG. 3. The four sorts of ink ejection data shown in FIG. 3 correspond to an image to be formed on the same region of the sheet P constituted by thirty six unit regions in total ranging over six rows from "1" to "6" and six columns from "a" to "f". Each of the characters "S", "M", and "L" in FIG. 3 represents the size of the dot to be formed on the corresponding unit region virtually defined on the sheet P. No dots are to be formed on unit regions in which no characters are described. The dot sizes S, M, L respectively correspond to the small droplet, the medium droplet, and the large droplet, ejected from each recording head 1*a*.

The treatment-liquid-ejection-data generating portion 56 is configured to generate treatment-liquid-ejection data on the basis of the ink ejection data stored in the ink-ejection-data storage portion 54. It is noted, however, that the treatment-liquid-ejection-data generating portion 56 may be configured to generate the treatment-liquid-ejection data on the basis of the image data stored in the image-data storage portion 52. The treatment-liquid-ejection-data storage portion 57 is configured to store the generated treatment-liquid-ejection data. The treatment-liquid-ejection data indicates a size of a dot (dot size) of the treatment liquid to be formed on each of the unit regions (pixel regions) virtually defined on the sheet P. The dot size indicated by the treatment-liquid-ejection data indicates a droplet amount of the treatment liquid to be ejected by the treatment-liquid ejecting head 1*b* to each unit region on the sheet P, i.e., an amount of the treatment liquid corresponding to zero, the small droplet, the medium droplet, or the large droplet.

FIG. 4 shows treatment-liquid-ejection data generated on the basis of the ink ejection data shown in FIG. 3, as one example of the treatment-liquid-ejection data. In FIG. 4, the character "S" indicates the size of the dot to be formed on the corresponding unit region virtually defined on the sheet P, and no dots are to be formed on unit regions in which the character "S" is not described. Here, the dot size S of the treatment-liquid-ejection data corresponds to the small droplet to be ejected from the treatment-liquid ejecting head 1*b*. Basically, the treatment-liquid-ejection data is generated such that a dot with the dot size S is formed selectively on each unit region on which the dot of the ink ejection data is to be formed. As a result, the treatment-liquid ejecting head 1*b* configured to eject the treatment liquid on the basis of the treatment-liquid-ejection data selectively ejects the small droplet of the treatment liquid to each of the unit regions on the sheet P to which the ink is to be ejected, such that the attaching positions of the ink and a coating range of the treatment liquid coincide with each other.

In the line-head type printer of the present embodiment, the treatment liquid and the ink are ejected to the sheet P that is being conveyed. Accordingly, the printing speed of the line-head type printer is higher than that of a serial-head type printer. On the other hand, there is not ensured enough time for the ink to be dried during conveyance of the sheet P on the conveyance path 5, so that the sheet P is likely to suffer from a curl. The curled sheet P is not stacked in good order when discharged onto the sheet discharge portion 15, causing a trouble that the sheet P is bent or placed out of position. In view of this, in the ink-jet printer 101 according to the present embodiment, the liquid count portion 61 and the curl estimate portion 62 of the controller 100 estimate or predict a degree of a curl that occurs in the sheet P, i.e., a curl degree, and the curl restrain portion 63 takes a measure for restraining the curl depending upon the estimated curl degree. Here, the "curl degree" directly or indirectly represents an amount of the curl that occurs in the sheet P, and is an index indicative of an extent of the curl. With reference to a flow chart of FIG. 5, there will be hereinafter described a method of estimating a curl of the sheet P according to the present embodiment.

Figure 6:
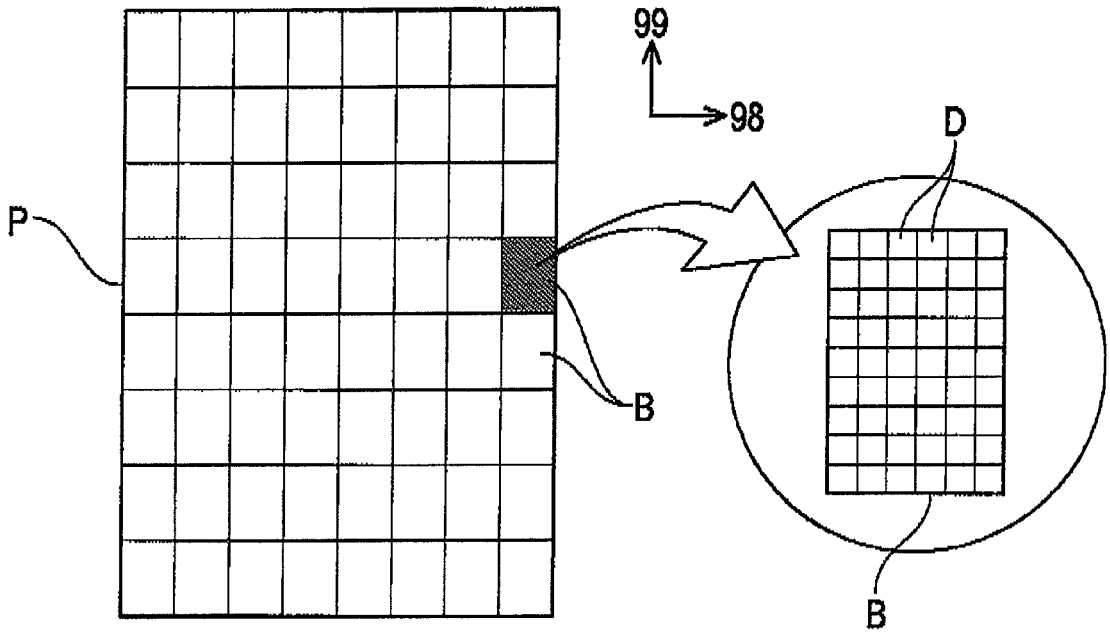
FIG. 6 is a view showing a relationship between a block and unit regions defined on a sheet.

Initially, the liquid count portion 61 as a calculating portion calculates a droplet number (ejected-liquid-droplet number) and a liquid amount (ejected-liquid amount) of each of blocks defined on the sheet P (Step S1). FIG. 6 is a view showing a relationship between a block B and unit regions D defined on the sheet P. As shown in FIG. 6, one sheet P (one page) and ink ejection data corresponding to the one sheet P are divided into prescribed midsize regions. Each midsize region is referred to as a "block B". For instance, where the sheet P is divided into eight rows in the conveyance direction 99 and eight columns in the recording-width direction 98, there are obtained sixty four blocks B in total. One block B is a region consisting of a plurality of unit regions D (pixel regions).

The droplet number of each block corresponds to a number of droplets ejected to the block virtually defined on the sheet P. Accordingly, a number of droplets (droplet number) of a certain block is equal to a number of dots of the ink ejection data corresponding to the block in question. In the present embodiment, the droplet number of the certain block is obtained first by counting the dot number of the block in question for each of the ink ejection data of the black ink, the cyan, ink, the magenta ink, and the yellow ink, and then by summing up the droplet numbers for the black ink, the cyan ink, the magenta ink, and the yellow ink. Where the four sorts of ink ejection data of FIGS. 3A-3D, each constituted by the thirty six unit regions (six rows×six columns), constitute ink ejection data of a certain one block, for instance, the droplet number of this block is twenty six (=six black droplets+three cyan droplets+six magenta droplets+eleven yellow droplets). Where different colors of inks are ejected to the same unit region, the droplet number of that unit region may be counted as one droplet. In this instance, the droplet number in the block of FIG. 3 is equal to twenty. Where the droplet amount to be ejected to one unit region on the sheet P is changed, one droplet whose size corresponds to the desired droplet amount may be ejected or a plurality of minute droplets having the same size may be successively ejected so as to correspond to the desired droplet amount. While, in the latter case, the number of the minute droplets is actually multiple, the multiple numbers of the minute droplets are counted as one.

A liquid amount of a block corresponds to a total of the ink droplet amounts ejected to the block virtually defined on the sheet P. Accordingly, the liquid amount of a certain block is obtained by summing up products each obtained by multiplying the number of dots of each dot size (S, M, L) in the ejection data of all colors of ink corresponding to the block, by the droplet amount of the corresponding dot size. Where the four sorts of ink ejection data of FIGS. 3A-3D, each constituted by the thirty six unit regions (six rows×six columns), constitute ink ejection data of a certain one block, for instance, the numbers of the S-size dots, the M-size dots, and the L-size dots of the block are ten, twelve, and four, respectively. Where the droplet amounts of the S-size dot, the M-size dot, and the L-size dot are 7 pl, 14 pl, and 21 pl, respectively, the liquid amount of this block is equal to 322 pl (=10×7 pl+12×14 pl+4×21 pl).

Figure 7:
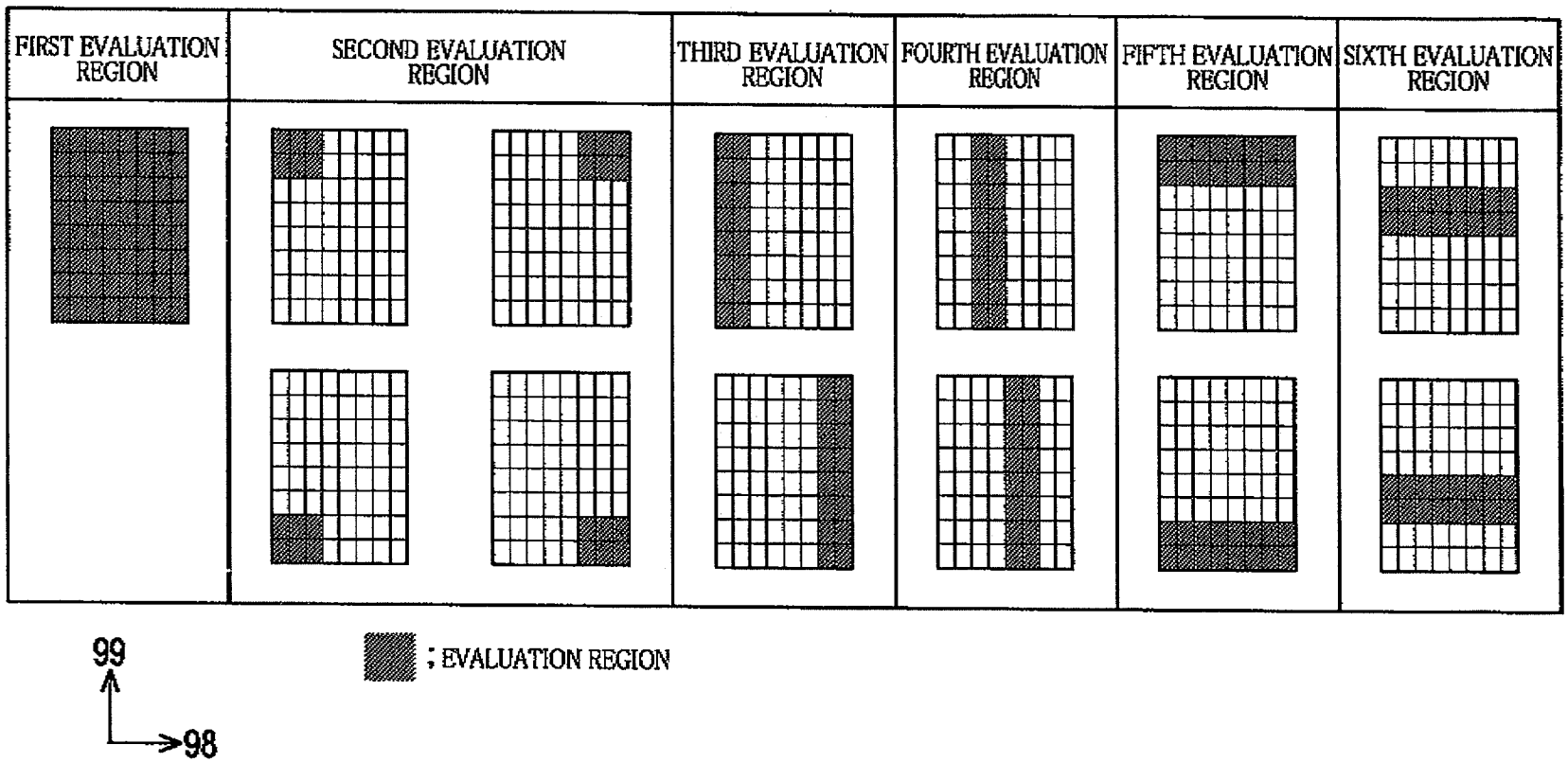
FIG. 7 is a table showing a relationship between each evaluation region and blocks defined on a sheet.

The liquid count portion 61 temporarily stores the droplet number and the liquid amount of each block calculated as described above (Step S2). Further, the liquid count portion 61 calculates a droplet number and a liquid amount of each of evaluation regions, utilizing the stored droplet number and liquid amount of each block (Step S3). FIG. 7 shows a relationship between each evaluation region and blocks defined on the sheet P. Here, the "evaluation region" is obtained by dividing one sheet P (one page) and the ink ejection data corresponding to the one sheet P into regions each being larger than one block. A droplet number of each evaluation region is a total of the droplet numbers of one or more blocks included in the evaluation region. A liquid amount of each evaluation region is a total of the liquid amounts of one or more block included in the evaluation region. The droplet number and the liquid amount of each evaluation region are utilized in estimating the curl degree.

FIG. 7 is a table showing examples of a plurality of i.e., first through sixth, patterns of evaluation regions. The first evaluation region indicated in the first column of the table includes all blocks of one sheet P. The second evaluation region indicated in the second column of the table includes four regions each consisting of six blocks included in two rows and three columns located at either one of four corners of the sheet P. The third evaluation region indicated in the third column of the table includes two regions extending in the conveyance direction 99 at one and the other of opposite ends of the sheet P in the recording-width direction 98. Each third evaluation region consists of blocks included in two columns located at one or the other of the opposite ends of the sheet P in the recording-width direction 98, so as to occupy a quarter (¼) of the entire region of the sheet P in the recording-width direction 98. The fourth evaluation region indicated in the fourth column of the table includes two regions each extending in the conveyance direction 99 at a middle portion of the sheet P in the recording-width direction 98. More specifically, each fourth evaluation region consists of blocks included in two columns located on one or the other side of a centerline of the sheet P in the recording-width direction 98, so as to occupy a quarter (¼) of the entire region of the sheet P in the recording-width direction 98. The fifth evaluation region indicated in the fifth column of the table includes two regions extending in the recording-width direction 98 at one and the other of opposite ends of the sheet P in the conveyance direction 99. Each fifth evaluation region consists of blocks included in two rows located at one or the other of the opposite ends of the sheet P in the conveyance direction 99, so as to occupy a quarter (¼) of the entire region of the sheet P in the conveyance direction 99. The sixth evaluation region indicated in the sixth column of the table includes two regions each extending in the recording-width direction 98 at a middle portion of the sheet P in the conveyance direction 99. More specifically, each sixth evaluation region consists of blocks included in two rows located on one or the other side of a centerline of the sheet P in conveyance direction 99, so as to occupy a quarter (¼) of the entire region of the sheet P in the conveyance direction 99.

The liquid count portion 61 temporarily stores the droplet number and the liquid amount of each of the first through sixth evaluation regions calculated as described above (Step S4). Subsequently, the curl estimate portion 62 estimates the curl degree of each evaluation region, utilizing the droplet number and the liquid amount calculated for each evaluation region. Here, the curl estimate portion 62 utilizes liquid-curl correlation information 64 pre-stored in the controller 100. The liquid-curl correlation information 64 is information indicative of a relationship between: the liquid amount and the droplet number; and the curl degree of the sheet P, for each evaluation region. The liquid-curl correlation information 64 is an empirically or theoretically formed map or formula and is formed for a position of each evaluation region, namely, for each evaluation region. In the present embodiment, for instance, the two third evaluation regions are symmetrical with respect to the recording-width direction 98. Accordingly, it is possible to use liquid-curl correlation information 64 common to the two third evaluation regions. Similarly, there can be used respective liquid-curl correlation information 64 each common to the four second evaluation regions, the two fourth evaluation regions, the two fifth evaluation regions, or the two sixth evaluation regions. In the present embodiment, therefore, the controller 100 stores six sorts of the liquid-curl correlation information 64 for the respective first-sixth evaluation regions.

Figure 8:
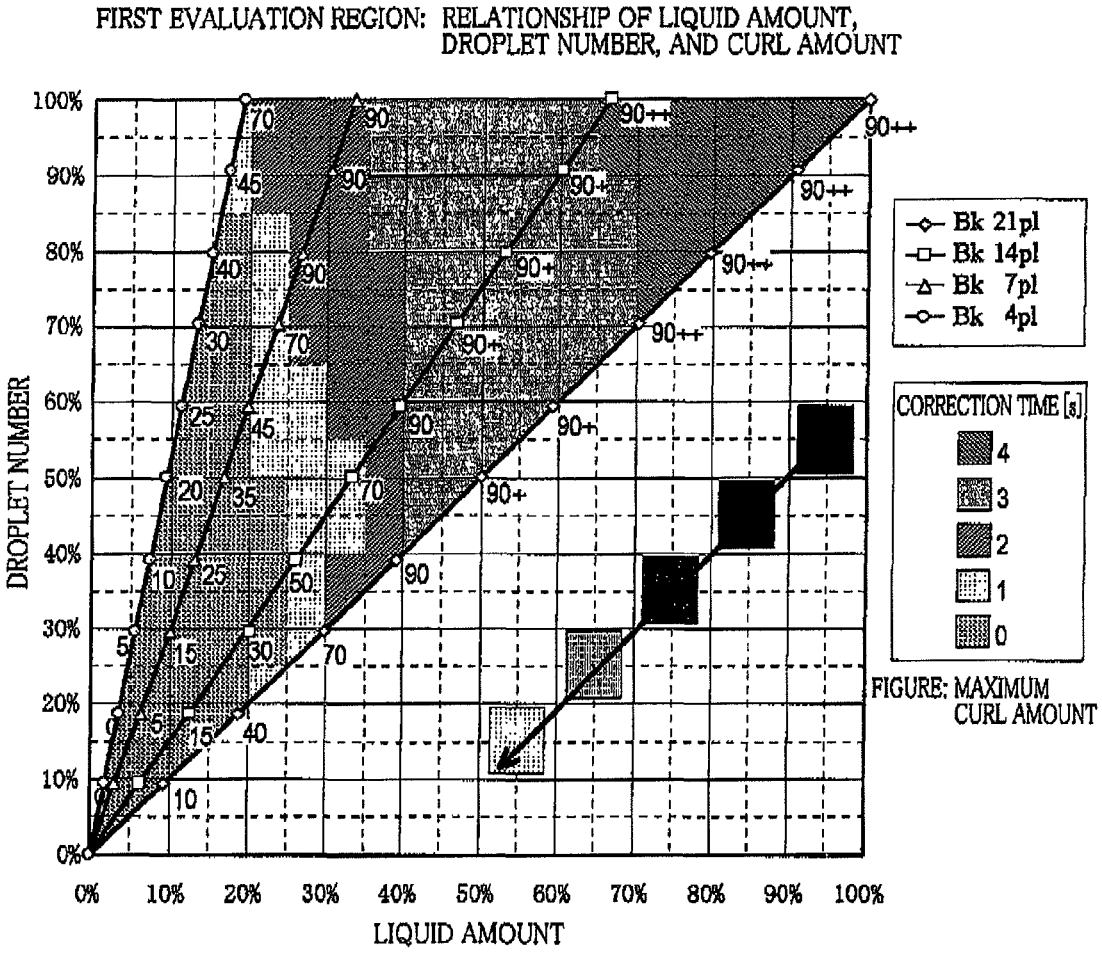
FIG. 8 is a view showing one example of liquid-curl correlation information of a first evaluation region.

FIG. 8 shows one example of the liquid-curl correlation information 64 for the first evaluation region. The liquid-curl correlation information 64 shown in FIG. 8 is a map showing maximum curl amount (as one example of the curl degree) associated with liquid amount and droplet number in the first evaluation region of FIG. 7. In this map, the vertical axis represents a ratio of the droplet number of the evaluation region. The ratio (percentage) of the droplet number of the evaluation region is represented such that the total dot number of the evaluation region is represented as 100%. In the example of FIG. 8, the droplet number is represented as 100% where the unit region is 600 dpi and the entirety of the A4 sheet is solidly painted with ink. Further, in the map, the horizontal axis represents a ratio of the liquid amount of the evaluation region. The ratio (percentage) of the liquid amount of the evaluation region is represented such that the liquid amount at a time when the evaluation region is painted with a maximum droplet amount of one solid color of ink is represented as 100%. In the example of FIG. 8, the liquid amount is represented as 100% where the unit region is 600 dpi and the entirety of the A4 sheet is solidly painted with the black ink with the droplet amount of 21 pl. Each of values indicated at coordinates defined by the vertical axis and the horizontal axis is the maximum curl amount of the sheet. The map further shows a correction time required for correcting or straightening a curl of the sheet P. The correction time that will be explained in detail is indicated in the map so as to be associated with the droplet number and the liquid amount, namely, the maximum curl amount, of the evaluation region.

Figure 9:
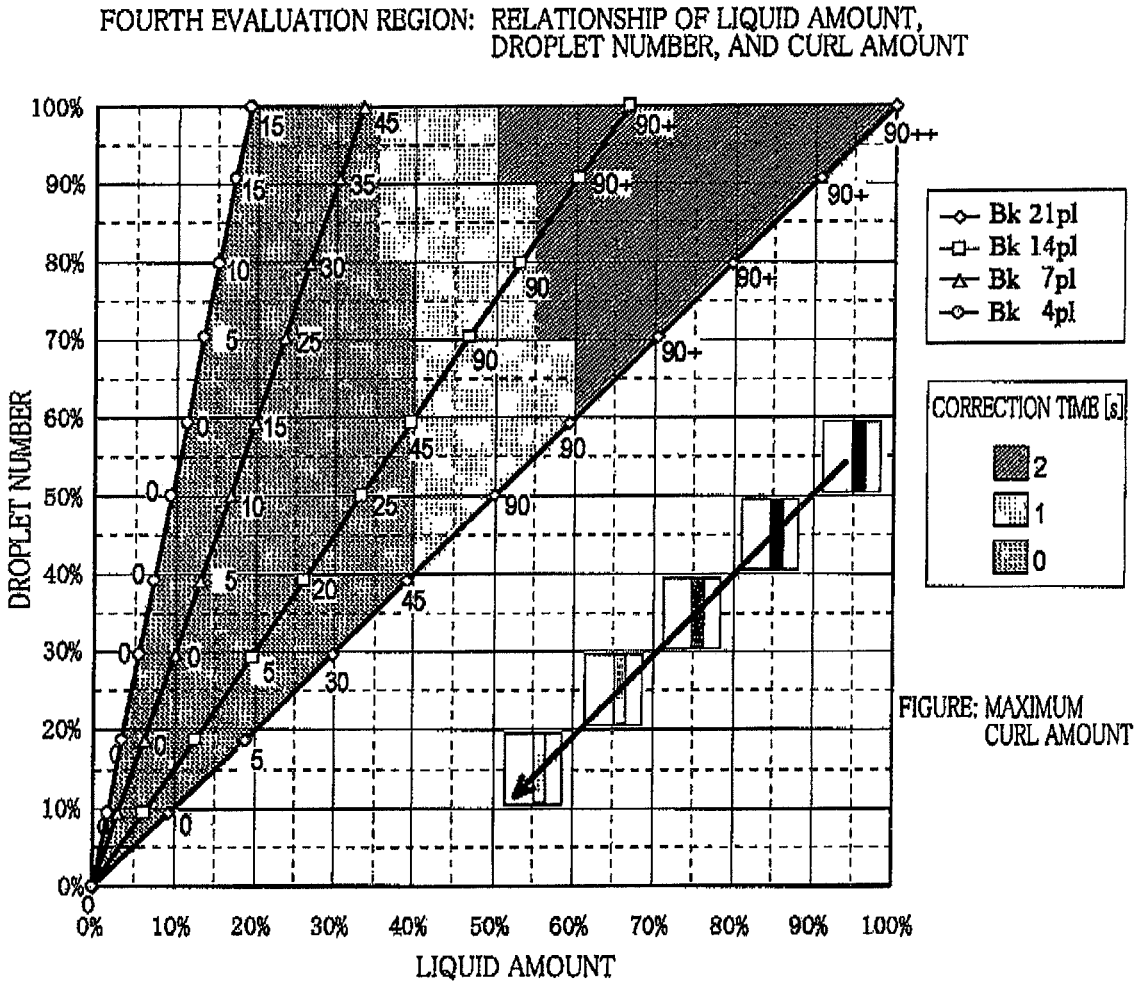
FIG. 9 is a view showing one example of liquid-curl correlation information of a fourth evaluation region.

FIG. 9 shows one example of the liquid-curl correlation information 64 for the fourth evaluation region. The liquid-curl correlation information 64 shown in FIG. 9 is a map showing maximum curl amount (as one example of the curl degree) associated with liquid amount and droplet number in the fourth evaluation region of FIG. 7. The map of FIG. 9 is used in a manner similar to that of the map of FIG. 8 explained with respect to the liquid-curl correlation information of the first evaluation region. In the map of FIG. 9, however, the vertical axis represents a ratio of the droplet number of the fourth evaluation region, such that the droplet number is represented as 100% where the unit region is 600 dpi and a region located at the widthwise middle portion of the A4 sheet so as to occupy a quarter (¼) of the entire region of the sheet P is solidly painted with ink. Further, the horizontal axis represents a ratio of the liquid amount of the fourth evaluation region, such that the liquid amount is represented as 100% where the unit region is 600 dpi and the above-indicated ¼ region located at the widthwise middle portion of the A4 sheet is solidly painted with the black ink of the droplet amount of 21 pl. When the liquid-curl correlation information 64 shown in FIG. 8 and the liquid-curl correlation information 64 shown in FIG. 9 are compared, it is to be understood that the curl degree varies depending upon the position or the pattern of the evaluation region even if the ratio of the droplet number and the ratio of the liquid amount for one evaluation region are identical with those for another evaluation region. It is to be further understood that the influence on the curl degree of the sheet varies depending upon the position or the pattern of the evaluation region.

As described above, the curl estimate portion 62 calculates the curl degree for each evaluation region, utilizing the droplet number and the liquid amount calculated for each evaluation region by the liquid count portion 61 (Step S5). In the present embodiment, the curl estimate portion 62 calculates the curl degree for each of the thirteen evaluation regions shown in FIG. 7. While the thus calculated thirteen curl degrees may differ from each other, the curl estimate portion 62 compares the curl degrees of all of the evaluation regions (Step S6) and estimates a maximum one of the curl degrees as the curl degree of the sheet P (Step S7).

Figure 10:
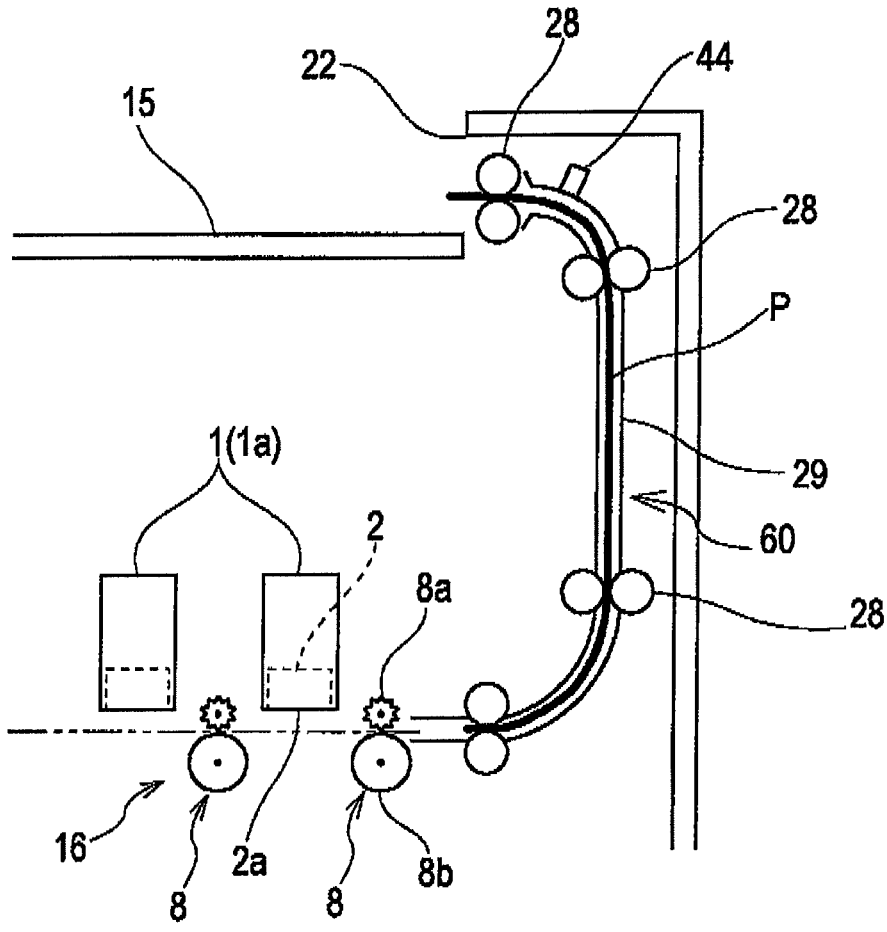
FIG. 10 is a view showing a state in which conveyance of a sheet is stopped in a feed-out path, as one example of a curl restraining measure.

Subsequently, there is taken a measure for restraining an occurrence of the curl by correcting or straightening the sheet that tends to be curled. To this end, the curl restrain portion 63 initially calculates a correction degree necessary for the sheet P (Step S8). In the present embodiment, for correcting the sheet P that tends to be curled, the sheet P is stopped to be conveyed for a predetermined correction time in a feed-out path 60 defined by the feed-out guides 29, as shown in FIG. 10. Here, the correction time corresponds to the correction degree. The correction degree is determined depending upon the curl degree of the sheet P estimated by the curl estimate portion 62. The curl restrain portion 63 calculates the correction degree on the basis of the estimated curl degree of the sheet P, utilizing curl-correction correlation information 65 which indicates correlation between the curl degree of the sheet P and the correction degree. This curl-correction correlation information 65 is an empirically or theoretically formed map or formula and has a tendency that the correction degree increases with an increase in the curl degree of the sheet P. In each of the maps shown in FIG. 8 and FIG. 9, the correction time (as one example of the correction degree) is also indicated in association with the droplet number and the liquid amount of the evaluation region (i.e., the maximum curl amount). Where such a map is used, the curl estimate portion 62, in place of the curl restrain portion 63 may calculate both of the curl degree and the correction degree. Here, the above-indicted Steps S5-S7 may be eliminated, and the correction degree necessary for the sheet may be directly calculated utilizing the droplet number and the liquid amount for each evaluation region calculated by the liquid count portion 61. In the present embodiment, the curl estimate portion 62 and the curl restrain portion 63 constitute an estimating portion of the invention configured to estimate at least one of the curl degree and the correction degree.

As explained above, the correction degree is calculated by the curl restrain portion 63. The correction degree may be adjusted or modified by an adjustment coefficient "a". Where the sheet P is a sheet having density lower than that of the plain paper, the curl is more likely to occur. Further, when the humidity detected by the humidity sensor 43 is lower than prescribed humidity, the curl is more likely to occur. In view of the above, the adjustment coefficient "a" may be set as a variable which is influenced by at least one factor described above, and a product obtained by multiplying the calculated correction degree by the adjustment coefficient "a" may be used as a real correction degree. For instance, the adjustment coefficient "a" may be set at 1 (a=1) where the sheet P is the plain paper while the adjustment coefficient "a" may be set at a value larger than 1, e.g., a value in a range of 1.5-2.0, where the sheet P is a sheet whose density is lower than that of the plain paper. Further, the adjustment coefficient "a" may be set at 1 (a=1) where the humidity detected by the humidity sensor 43 falls within a prescribed range while the adjustment coefficient "a" may be set at a value larger than 1, e.g., a value in a range of 1.1-1.5 where the humidity detected by the humidity sensor 43 is lower than prescribed humidity.

The curl restrain portion 63 evaluates the calculated correction degree and determines whether or not it is necessary to carry out a measure for restraining the curl (Step S9). In the present embodiment, the correction degree is the correction time, and no particular measures for restraining the curl are carried out where the correction time is not larger than 0 (threshold) (Step S9: NO). On the other hand, where the correction time is larger than 0 (the threshold) (Step S9: YES), the curl restraining measure is carried out (Step S10). More specifically, the curl restrain portion 63 sends, to the conveyance control portion 59, a command for carrying out the curl restraining measure and the correction degree. The conveyance control portion 59 detects that the sheet P is sent to the feed-out path 60 from the conveyance unit 16, utilizing the sheet discharge sensor 44 or another sensor provided in the feed-out path 60 and stops rotation of the feed-out roller pairs 28 for a time period corresponding to the correction time. As a result, the sheet P is kept sandwiched by and between the rollers of the feed-out roller pairs 28 for a prescribed correction time with the curl of the sheet P corrected or straightened, whereby the ink coated on the sheet P dries and therefore the curl of the sheet P is restrained from occurring. Where the correction time is larger than a certain threshold, the ink ejection data or the treatment-liquid-ejection data may be changed such that the correction time is made shorter by reducing the dot size or the droplet number of the ink or the treatment liquid.

As explained above, the curl estimating method according to the present embodiment includes: the step of calculating the liquid amount (the ejected-liquid amount) ejected by the ink-jet printer 101 to each evaluation region defined on the sheet P and the droplet number (the ejected-liquid-droplet number), as an ejected-liquid associated quantity, ejected by the ink-jet printer 101 to each evaluation region; and the step of estimating the curl degree of the sheet caused by ejection of the ink as the liquid onto the sheet P, on the basis of the position of each evaluation region on the sheet P, the liquid amount, and the droplet number ejected to each evaluation region. In the present curl estimating method, the curl degree of the sheet P is estimated on the basis of the liquid amount and the droplet number ejected to a certain evaluation region, so that the curl degree to be estimated is more accurate. Further, the measure to deal with the curl, i.e., to restrain the curl, is carried out on the basis of the thus accurately estimated curl degree, whereby the curl can be efficiently and sufficiently restrained with necessary and sufficient time and energy.

Further, in the curl estimating method according to the present embodiment, the curl degree of the sheet P is calculated for each of the plurality of evaluation regions, and a maximum one of the curl degrees is used as the estimated curl degree of the sheet P. According to the method, it is possible to accurately estimate the degree of the curl that occurs in the sheet P even under a condition in which the curl occurs locally in the sheet. Where the ink is ejected concentratedly to a portion of the sheet P, for instance, the curl may locally occur in the sheet P. In this case, the curl degree of the sheet P calculated for one evaluation region to which the ink is concentratedly ejected is larger than the curl degrees of other evaluation regions. Accordingly, by using the maximum one of the calculated curl degrees as the curl degree of the sheet P, it is possible to estimate the curl degree even if the curl is locally occurred one.

Further, in the curl estimating method according to the present embodiment, a plurality of patterns of evaluation regions are set, the curl degree of the sheet P is calculated for each evaluation region, and the maximum one of the curl degrees is used as the estimated curl degree of the sheet P. Accordingly, it is possible to more accurately estimate the curl that occurs in the sheet P.

Moreover, in the curl estimating method according to the present embodiment, the correction degree for restraining the curl is calculated on the basis of the curl degree of the sheet P estimated by the curl estimate portion 62. Further, it is judged, on the basis of the estimated curl degree of the sheet P, whether it is necessary or not to carry out the measure for restraining the curl. That is, under an ink ejection condition in which any curl will not occur in the sheet P, the curl correction is not carried out, so that high-speed printing is not hindered. On the other hand, under an ink ejection condition in which the curl will occur in the sheet P, the correction degree, here, the correction time, is set in accordance with the estimated curl degree of the sheet P, whereby the curl correction is carried out with a minimum required time. Accordingly, it is possible to suppress of a reduction in the printing speed.

While one preferred embodiment of the invention has been descried, it is to be understood that the invention is not limited to the details of the illustrated embodiment, but may be embodied with various modifications without departing from the scope of the invention defined in the attached claims.

For instance, the thirteen evaluation regions which are obtained by dividing the sheet P with six patterns are defined on the sheet P in the illustrated embodiment. There may be set other patterns of evaluation regions, or the number of the evaluation regions may be increased or decreased. Moreover, for enhancing the calculation speed, the droplet number, the liquid amount, and the curl degree of the sheet P may be calculated for only the evaluation regions whose curl degrees are relatively largely influenced.

In the illustrated embodiment, sixty four blocks are defined on one sheet. The sheet may be divided into larger or smaller blocks than the blocks in the illustrated embodiment. Alternatively, the concept of the block may be eliminated, in other words, the calculation of the droplet number and the liquid amount for each block may be eliminated, and the droplet number and the liquid amount for each evaluation region may be directly calculated.

Figure 5:
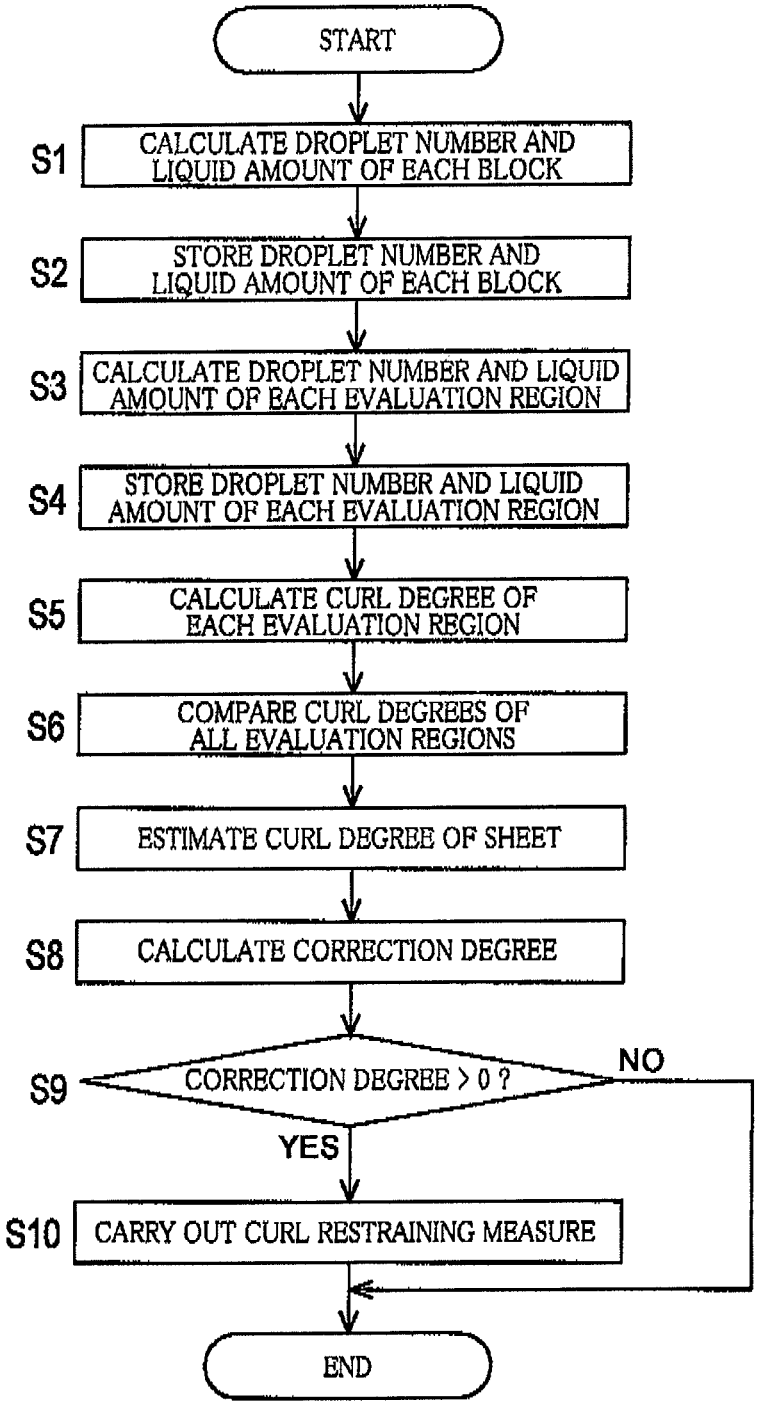
FIG. 5 is a flow chart for explaining a flow of a curl estimating method.
Figure 11:
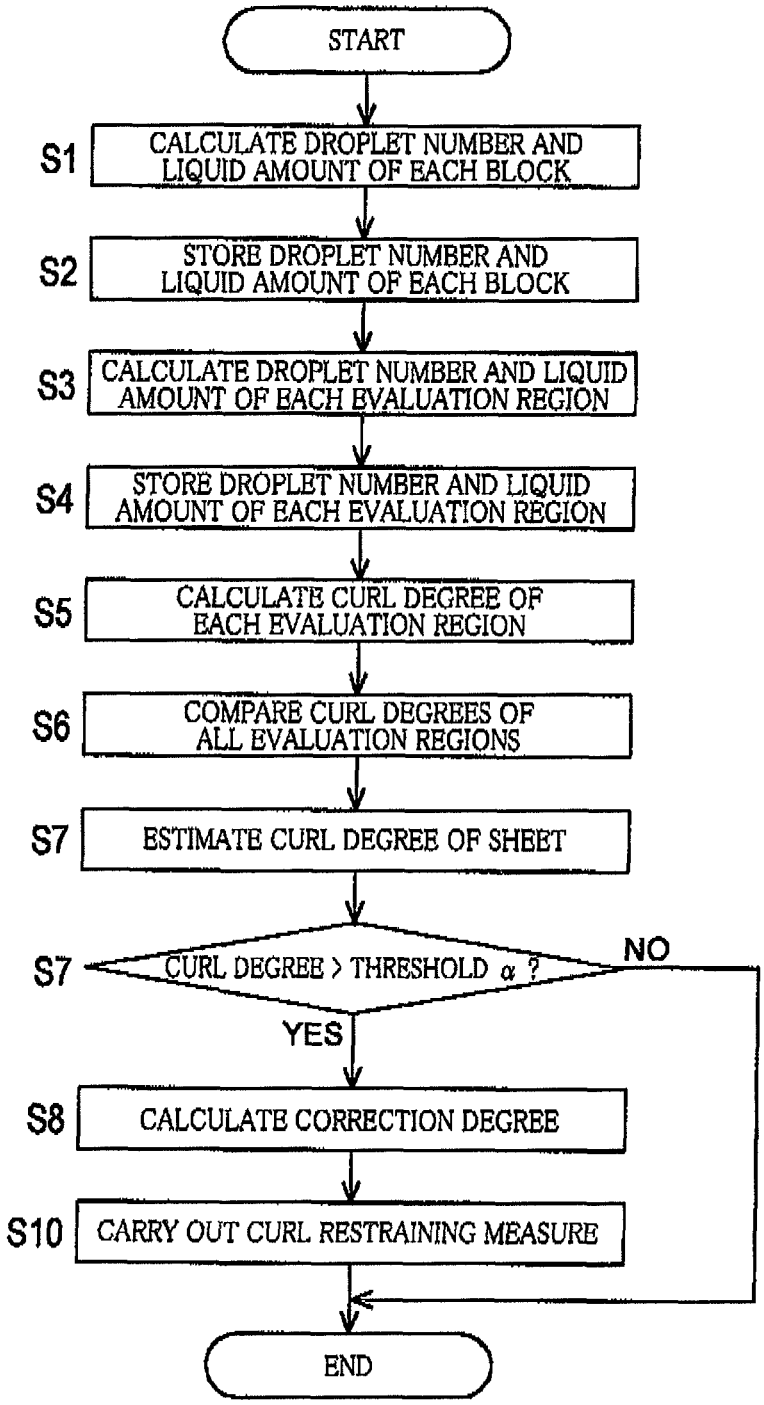
FIG. 11 is a flow chart for explaining a flow of a curl estimating method according to a modified embodiment.

In the illustrated embodiment, it is judged, on the basis of the correction degree, whether or not it is necessary to carry out the curl restraining measure (Step S9 in FIG. 5). The judgment may be made on the basis of the curl degree of the sheet P. FIG. 11 is a flow chart for explaining a curl estimating method according to a modified embodiment. For instance, as shown in FIG. 11, after the curl degree of the sheet P has been estimated (Step S7), it may be judged whether or not it is necessary to carry out the curl restraining measure by comparing the estimated curl degree of the sheet P and a prescribed threshold $\alpha$. In this instance, where the curl degree is not larger than the threshold $\alpha$ (Step S7': NO), the curl restraining measure is not carried out. On the other hand, where the curl degree exceeds the threshold $\alpha$(Step S7': YES), the curl restraining measure is carried out (Steps S8 and S9). As in the illustrated embodiment in which the adjustment coefficient "a" is set for the correction degree, an adjustment coefficient "b" may be set for the threshold $\alpha$. In this instance, the adjustment coefficient "b" is a variable using, as a parameter, the humidity in the housing 102 detected by the humidity sensor 43, the density of the sheet P, or the like. For instance, the adjustment coefficient "b" may be set at 1 (b=1) where the sheet P is the plain paper while the adjustment coefficient "b" may be set at a value smaller than 1 (e.g., a value in a range of 0.7-0.9) where the sheet P is a sheet whose density is smaller than that of the plain paper. Further, the adjustment coefficient "b" may be set at 1 (b=1) where the humidity detected by the humidity sensor 43 falls within a prescribed range while the adjustment coefficient "b" may be set at a value smaller than 1 where the humidity detected by the humidity sensor 43 is lower than prescribed humidity. Thus, a value smaller than the threshold $\alpha$ may be used as a substantial threshold $\alpha$, depending upon the humidity in the housing 102 or the density of the sheet P.

In the illustrated embodiment, as the measure or technique for restraining the curl of the sheet P, the conveyance of the sheet P is temporarily stopped in the feed-out path 60. The curl restraining measure or technique is not limited to that described above. For instance, in place of the technique described above, there may be employed a technique of reducing the conveyance speed of the sheet P in the feed-out path 60. In this instance, the reduction degree of the conveyance speed is used as the correction degree. Further, in place of the technique described above, a heating and pressurizing device, such as a roller pair(s), may be provided in the feed-out path 60, for heating and pressurizing the sheet P that is being conveyed in the feed-out path 60, from opposite surfaces (front and back surfaces) of the sheet P. In this instance, the pressurizing degree and the heating time are used as the correction degree.

In the illustrated embodiment, the correction degree calculated by the curl restrain portion 63 is adjusted or modified by the adjustment coefficient "a". In place of the correction degree, the droplet amount or the droplet number may be multiplied by the adjustment coefficient "a". In this instance, the adjustment coefficient "a" may be set at 1 (a=1) where the sheet is the plain paper, may be set at a value of 0.5-0.9 (a=0.5-0.9) where the sheet P is thick paper, and may be set at a value of 1.5-2.0 (a=1.5-2.0) where the sheet P is thin paper, for example. Where the sheet P is short grain paper, the adjustment coefficient "a" may be set at a value of 0.5-0.9 (a=0.50.9) for the third and fourth evaluation regions shown in FIG. 7 and may be set at a value of 1.5-2.0 (a=1.5-2.0) for the fifth and sixth evaluation regions shown in FIG. 7. Instead of the adjustment coefficient "a", the correction degree may be modified or adjusted by a plurality of formulas or maps in accordance with conditions of the respective evaluation regions.

As described above, the correction degree necessary for the sheet may be directly calculated, utilizing the droplet number and the liquid amount of each evaluation region calculated by the liquid count portion 61. In this instance, the correction degree may be calculated from liquid-correction correlation information. That is, it is not necessary to obtain the curl amount.

As described above, the droplet number may be counted as one even where a plurality of droplets are ejected to the same one unit area. In this instance, the droplet number in one evaluation region corresponds to an attached area of the evaluation region to which the droplets are attached. In other words, the curl degree (the curl correction degree) may be calculated on the basis of the liquid amount of each evaluation region and an attached area on the surface of the evaluation region to which the droplets are attached, namely, an area of the unit regions of the evaluation region to which the ink is ejected. The curl degree is influenced by an area, in particular, a continuous area, of the surface of the recording medium to which the droplets are attached, or a ratio of the attached area to the entire area of the surface of the recording medium. Accordingly, calculating the curl degree (the curl correction degree) on the basis of the attached area or the ratio thereof is effective. The attached area and the ratio thereof may be referred to as "ejected-area associated quantity". Further, the droplet number (the ejected-liquid-droplet number) and the attached area and the ratio thereof (the ejected-area associated quantity) may be referred to as "ejected-liquid associated quantity".

The present invention is applicable to liquid ejecting apparatus configured to eject a liquid other than the ink. Further, the present invention is applicable to a facsimile machine and a copying machine other than the printer. In the illustrated embodiment, the head control portion 51 is configured to drive the actuators of the treatment-liquid ejecting head 1*b* and the actuators of each recording head 1*a*. The heads 1 may be otherwise driven. For instance, the treatment-liquid ejecting head 1*b* and the recording head 1*a* may be equipped with a heater element, and the treatment liquid and the ink may be ejected from the respective heads by driving the heater element.

What is claimed is:

1. A method of dealing with a curl of a recording medium caused by ejection of a liquid by a droplet ejecting apparatus to the recording medium, comprising the steps of:

calculating (I) an ejected-liquid amount which is an amount of the liquid ejected by the droplet ejecting apparatus to an evaluation region defined on the recording medium and (II) an ejected-liquid associated quantity which is one of (a) an ejected-liquid-droplet number which is a number of droplets of the liquid ejected to the evaluation region and (b) an ejected-area associated quantity which is one of: an area of unit regions in the evaluation region to which the liquid is ejected; and a ratio of the area of the unit regions to an area of the evaluation region; and estimating at least one of: a curl degree which is a degree of the curl of the recording medium caused by ejection of the liquid to the recording medium; and a correction degree which is a degree of correction necessary for restraining the curl, on the basis of: a position of the evaluation region; and the ejected-liquid amount and the ejected-liquid associated quantity calculated in the calculating step, wherein the ejected-liquid amount and the ejected-liquid associated quantity are calculated in the calculating step for each of a plurality of evaluation regions each as the evaluation region, wherein at least one of the curl degree and the correction degree is estimated in the estimating step on the basis of: the position of each of the plurality of evaluation regions; and the ejected-liquid amount and the ejected-liquid associated quantity calculated for each of the plurality of evaluation regions, and wherein the plurality of evaluation regions include a plurality of regions obtained by dividing the recording medium with a plurality of mutually different patterns.

2. The method according to claim 1, wherein the estimating step comprises estimating at least the curl degree.

3. The method according to claim 1, wherein the estimating step comprises estimating at least the correction degree.

4. The method according to claim 1, wherein the estimating step comprises estimating the curl degree on the basis of: the position of the evaluation region; and the ejected-liquid amount and the ejected-liquid associated quantity calculated in the calculating step and comprises estimating the correction degree on the basis of the estimated curl degree.

5. The method according to claim 1, wherein the ejected-liquid-droplet number is calculated in the calculating step as the ejected-liquid associated quantity, and wherein at least one of the curl degree and the correction degree is estimated in the estimating step on the basis of: the position of the evaluation region; and the ejected-liquid amount and the ejected-liquid-droplet number calculated in the calculating step.

6. The method according to claim 1, wherein the ejected-area associated quantity is calculated in the calculating step as the ejected-liquid associated quantity, and wherein at least one of the curl degree and the correction degree is estimated in the estimating step on the basis of: the position of the evaluation region; and the ejected-liquid amount and the ejected-area associated quantity calculated in the calculating step.

7. The method according to claim 1, wherein the estimating step comprises estimating at least one of the curl degree and the correction degree utilizing correlation information which is prepared in advance and which indicates a relationship of the ejected-liquid amount, the ejected-liquid associated quantity, and the curl degree.

8. The method according to claim 1, wherein at least one of a plurality of curl degrees and a plurality of correction degrees respectively corresponding to the plurality of evaluation regions is estimated in the estimating step on the basis of: the position of each of the plurality of evaluation regions; and the ejected-liquid amount and the ejected-liquid associated quantity calculated for each of the plurality of evaluation regions calculated in the calculating step, and wherein at least one of: a maximum one of the plurality of curl degrees; and a maximum one of the plurality of correction degrees is estimated as the at least one of the curl degree and the correction degree for the recording medium.

9. A droplet ejecting apparatus, comprising:

at least one liquid ejecting head for ejecting a liquid to a recording medium;

a liquid-ejection-data storage portion for storing liquid-ejection data on the basis of which the liquid is ejected so as to correspond to an image to be formed on the recording medium;

a liquid-ejecting-head control portion for controlling the at least one liquid ejecting head on the basis of the liquid-ejection data;

a calculating portion for calculating (I) an ejected-liquid amount which is an amount of the liquid ejected by the droplet ejecting apparatus to an evaluation region defined on the recording medium and (II) an ejected-liquid associated quantity which is one of (a) an ejected-liquid-droplet number which is a number of droplets of the liquid ejected to the evaluation region and (b) an ejected-area associated quantity which is one of: an area of unit regions in the evaluation region to which the liquid is ejected; and a ratio of the area of the unit regions to an area of the evaluation region, and an estimating portion for estimating at least one of: a curl degree which is a degree of the curl of the recording medium caused by ejection of the liquid to the recording medium and a correction degree which is a degree of correction necessary for restraining the curl, on the basis of: a position of the evaluation region; and the ejected-liquid amount and the ejected-liquid associated quantity calculated in the calculating step, wherein the calculating portion is configured to calculate the ejected-liquid amount and the ejected-liquid associated quantity for each of a plurality of evaluation regions each as the evaluation region, wherein the estimating portion is configured to estimate at least one of the curl degree and the correction degree on the basis of: the position of each of the plurality of evaluation regions; and the ejected-liquid amount and the ejected-liquid associated quantity calculated for each of the plurality of evaluation regions, wherein the estimating portion is configured to estimate at least one of a plurality of curl degrees and a plurality of correction degrees respectively corresponding to the plurality of evaluation regions on the basis of: the position of each of the plurality of evaluation regions; and the ejected-liquid amount and the ejected-liquid associated quantity calculated for each of the plurality of evaluation regions and is configured to estimate at least one of: a maximum one of the plurality of curl degrees; and a maximum one of the plurality of correction degrees, as the at least one of the curl degree and the correction degree for the recording medium, and wherein the plurality of evaluation regions include a plurality of regions obtained by dividing the recording medium with a plurality of mutually different patterns.

10. The apparatus according to claim 9, wherein the estimating portion includes a curl-degree estimating potion for estimating the curl degree and a correction-degree estimating portion for estimating the correction degree on the basis of the estimated curl degree.

11. The apparatus according to claim 9, wherein the estimating portion is configured to estimate at least one of the curl degree and the correction degree utilizing correlation information which is prepared in advance and which indicates a relationship of the ejected-liquid amount, the ejected-liquid associated quantity, and the curl degree.

12. A non-transitory computer-readable storage medium in which is computer-readably stored a program to be executed by a computer of a droplet ejecting apparatus, in order to deal with a curl of a recording medium caused by ejection of a liquid by the droplet ejecting apparatus to the recording medium, the program including the steps of:

calculating (I) an ejected-liquid amount which is an amount of the liquid ejected by the droplet ejecting apparatus to an evaluation region defined on the recording medium and (II) an ejected-liquid associated quantity which is one of (a) an ejected-liquid-droplet number which is a number of droplets of the liquid ejected to the evaluation region and (b) an ejected-area associated quantity which is one of: an area of unit regions in the evaluation region to which the liquid is ejected; and a ratio of the area of the unit regions to an area of the evaluation region, and estimating at least one of: a curl degree which is a degree of the curl of the recording medium caused by ejection of the liquid to the recording medium; and a correction degree which is a degree of correction necessary for restraining the curl, on the basis of: a position of the evaluation region; and the ejected-liquid amount and the ejected-liquid associated quantity calculated in the calculating step, wherein the ejected-liquid amount and the ejected-liquid associated quantity are calculated in the calculating step for each of a plurality of evaluation regions each as the evaluation region, wherein at least one of the curl degree and the correction degree is estimated in the estimating step on the basis of: the position of each of the plurality of evaluation regions; and the ejected-liquid amount and the ejected-liquid associated quantity calculated for each of the plurality of evaluation regions, and wherein the plurality of evaluation regions include a plurality of regions obtained by dividing the recording medium with a plurality of mutually different patterns.

13. The non-transitory computer-readable storage medium according to claim 12, wherein the estimating step comprises estimating at least the curl degree.

14. The non-transitory computer-readable storage medium according to claim 12, wherein the estimating step comprises estimating at least the correction degree.

* * * * *